US010088776B2

(12) United States Patent
Hosokawa et al.

(10) Patent No.: US 10,088,776 B2
(45) Date of Patent: Oct. 2, 2018

(54) DEVELOPING DEVICE, AND IMAGE FORMING APPARATUS AND PROCESS CARTRIDGE INCORPORATING SAME

(71) Applicants: Ricoh Company, Ltd., Ohta-ku, Tokyo (JP); Sayuri Katoh, Ohta-ku, Tokyo (JP)

(72) Inventors: Hiroshi Hosokawa, Kanagawa (JP); Shinji Tamaki, Tokyo (JP); Keiichi Yoshida, Kanagawa (JP); Ichiro Kadota, Kanagawa (JP); Shunji Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/278,055

(22) Filed: Sep. 28, 2016

(65) Prior Publication Data

US 2017/0115604 A1 Apr. 27, 2017

(30) Foreign Application Priority Data

Oct. 22, 2015 (JP) ..... 2015-208416

(51) Int. Cl.
*G03G 15/08* (2006.01)
*G03G 15/09* (2006.01)

(52) U.S. Cl.
CPC ..... *G03G 15/0891* (2013.01); *G03G 15/0812* (2013.01); *G03G 15/0921* (2013.01)

(58) Field of Classification Search
None
See application file for complete search history.

(56) References Cited

U.S. PATENT DOCUMENTS

2002/0044796 A1* 4/2002 Hibino ..... B82Y 15/00 399/267
2005/0002701 A1* 1/2005 Ikeguchi ..... G03G 15/09 399/267
2005/0238384 A1 10/2005 Sampe et al.
(Continued)

FOREIGN PATENT DOCUMENTS

JP 4-037773 2/1992
JP 2000-206792 7/2000
(Continued)

*Primary Examiner* — Sevan A Aydin
(74) *Attorney, Agent, or Firm* — Harness, Dickey & Pierce, P.L.C.

(57) ABSTRACT

A developing device includes a developer bearer including a magnetic field generator, a developer regulator disposed opposite the developer bearer across a regulation gap, a developer containing compartment disposed below the developer bearer, and a conveying screw disposed in the developer containing compartment and including a shaft having a diameter greater than a radius of the conveying screw. On a cross section perpendicular to an axial direction of the conveying screw, a developer scooping pole of the magnetic field generator to scoop the developer from the developer containing compartment onto the developer bearer is disposed between the regulation gap and a bisector dividing an angle extending from a first line, which connects a center of the developer bearer and a center of the conveying screw, to a second line, which connects the center of the developer bearer and the regulation gap, in a rotation direction of the developer bearer.

18 Claims, 10 Drawing Sheets

(56) References Cited

U.S. PATENT DOCUMENTS

| | | | | |
|---|---|---|---|---|
| 2006/0008296 | A1 | 1/2006 | Sampe et al. | |
| 2006/0115292 | A1 | 6/2006 | Sampe et al. | |
| 2006/0115302 | A1 | 6/2006 | Hosokawa et al. | |
| 2006/0120741 | A1 | 6/2006 | Murakami et al. | |
| 2007/0166074 | A1 | 7/2007 | Hosokawa et al. | |
| 2009/0245889 | A1* | 10/2009 | Koetsuka ..... | G03G 15/0921 399/277 |
| 2010/0014895 | A1 | 1/2010 | Hosokawa et al. | |
| 2010/0129113 | A1 | 5/2010 | Sampe et al. | |
| 2010/0202805 | A1 | 8/2010 | Miyoshi et al. | |
| 2010/0215397 | A1 | 8/2010 | Sampe et al. | |
| 2011/0008073 | A1 | 1/2011 | Kudo et al. | |
| 2011/0026973 | A1 | 2/2011 | Hosokawa et al. | |
| 2011/0150525 | A1 | 6/2011 | Fujiwara et al. | |
| 2011/0243612 | A1 | 10/2011 | Hosokawa et al. | |
| 2012/0063813 | A1* | 3/2012 | Mihara ..... | G03G 15/0808 399/254 |
| 2012/0230736 | A1 | 9/2012 | Hosokawa et al. | |
| 2014/0016960 | A1 | 1/2014 | Miyoshi et al. | |
| 2014/0233984 | A1 | 8/2014 | Miyoshi et al. | |
| 2014/0314451 | A1 | 10/2014 | Hosokawa et al. | |
| 2016/0026116 | A1 | 1/2016 | Hosokawa et al. | |

FOREIGN PATENT DOCUMENTS

| | | | | |
|---|---|---|---|---|
| JP | 2005-148413 | | 6/2005 | |
| JP | 2015011042 | A * | 1/2015 | ..... G03G 15/0891 |
| JP | 2015-215369 | | 12/2015 | |

* cited by examiner

DEVELOPING DEVICE, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. § 119(a) to Japanese Patent Application No. 2015-208416, filed on Oct. 22, 2015, in the Japan Patent Office, the entire disclosure of which is hereby incorporated by reference herein.

BACKGROUND

Technical Field

Embodiments of the present invention generally relate to a developing device, and a process cartridge and an image forming apparatus, such as a copier, a printer, a facsimile machine, or a multifunction peripheral having at least two of copying, printing, facsimile transmission, plotting, and scanning capabilities, that include the developing device.

Description of the Related Art

There are developing devices that include a developer containing compartment to contain two-component developer including magnetic carrier and toner and a developer bearer containing a magnetic field generator. The magnetic field generator exerts a magnetic force to attract the two-component developer onto the surface of the developer bearer, and the developer bearer transports the developer to a developing range facing a latent image bearer.

Such developing devices further include a developer regulator and a developer conveyor to stir and transport the developer inside the developer containing compartment adjacent to the developer bearer. The developer regulator is disposed across a gap (i.e., a regulation gap) from the surface of the developer bearer to adjust the amount of developer borne on the surface of the developer bearer. For example, the developer conveyor is a conveying screw including a shaft and a spiral blade winding around the shaft. While being transported by the conveying screw, the developer is attracted by the magnetic force of a developer scooping pole of the magnetic field generator and borne on the surface of the developer bearer.

SUMMARY

An embodiment of the present invention provides a developing device that includes a developer bearer including a magnetic field generator, a developer regulator disposed opposite the developer bearer across a regulation gap to adjust an amount of developer borne on a surface of the developer bearer, a developer containing compartment disposed below the developer bearer, and a conveying screw disposed in the developer containing compartment and including a shaft having a diameter greater than a radius of the conveying screw. The conveying screw transports the developer in the developer containing compartment. The magnetic field generator has a developer scooping pole to scoop the developer in the developer containing compartment onto the surface of the developer bearer, and the developer bearer bears the developer and transports the developer to a developing range. On a cross section perpendicular to an axial direction of the conveying screw, the developer scooping pole is disposed between the regulation gap and a bisector dividing an angle extending from a first line, which connects a center of the developer bearer and a center of the conveying screw, to a second line, which connects the center of the developer bearer and the regulation gap, in a rotation direction of the developer bearer.

In another embodiment, a developing device includes the developer bearer, the developer, the developer containing compartment, and the conveying screw described above. On a cross section perpendicular to the axial direction of the conveying screw, a peak position of a magnetic-flux density of the developer scooping pole in a direction normal to the surface of the developer bearer is disposed between the developer regulator and a tangent line in the rotation direction of the developer bearer. The tangent line is a downstream one, in the rotation direction of the developer bearer, of two lines that are tangential to the conveying screw and pass the center of the developer bearer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
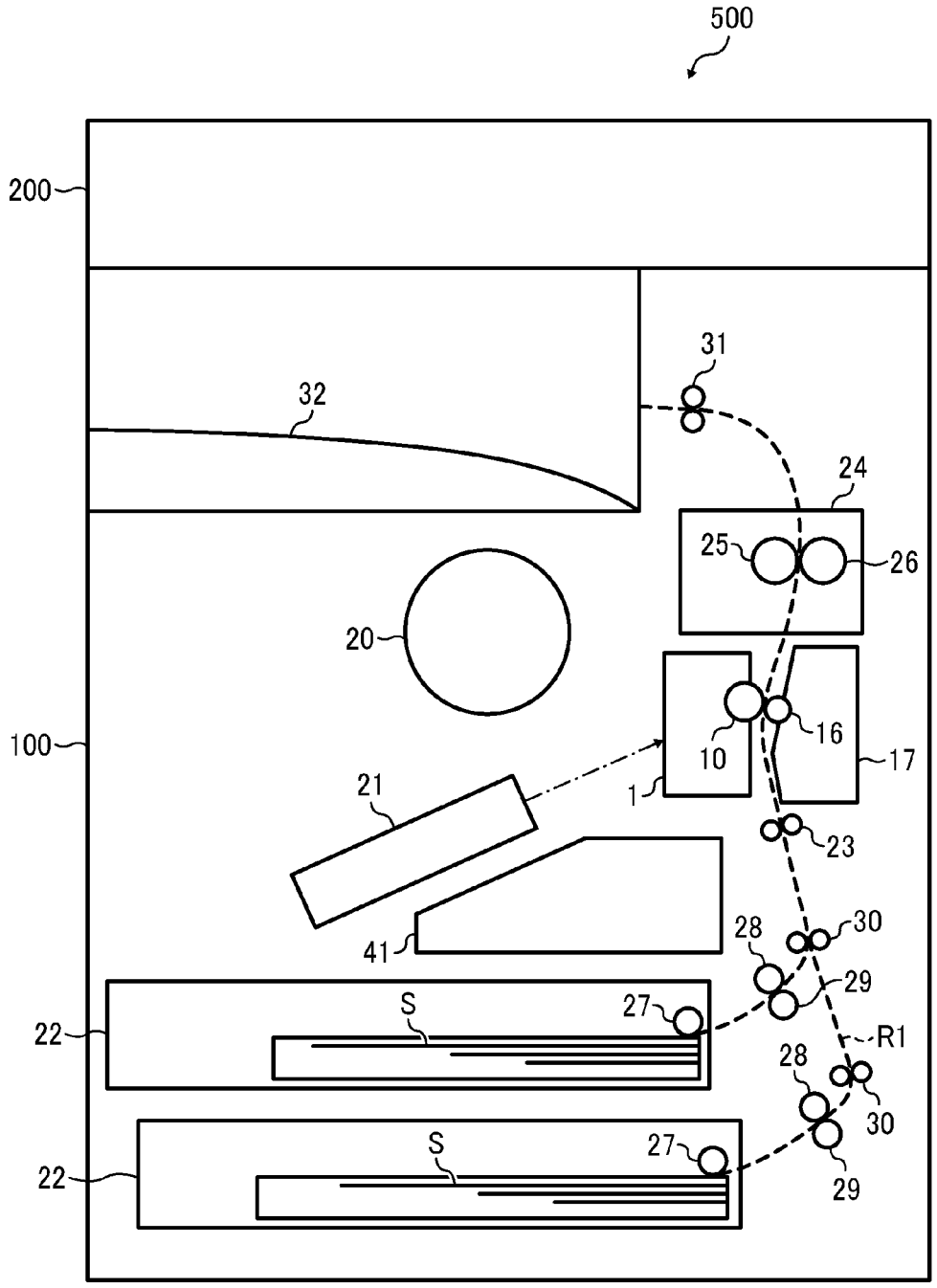
FIG. 1 is a schematic view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic view of an image forming apparatus 500 according to an embodiment.

For example, the image forming apparatus 500 is a copier and includes a scanner 200 (i.e., an image reading device) disposed above an apparatus body 100. The apparatus body 100 contains a process cartridge 1.

Figure 2A:
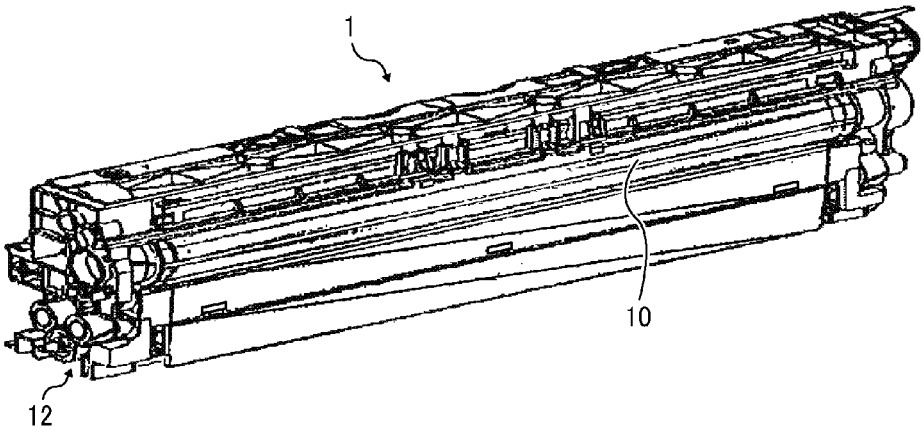
FIG. 2A is a perspective view of a process cartridge of the image forming apparatus illustrated in FIG. 1.
Figure 2B:
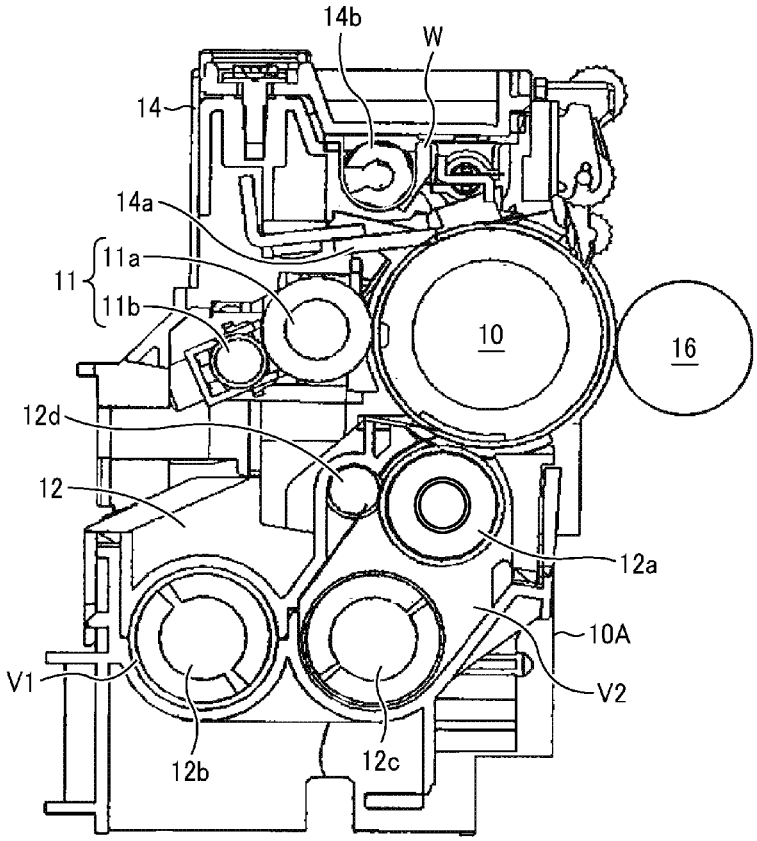
FIG. 2B is a cross-sectional view of the process cartridge illustrated in FIG. 2A.

FIG. 2A is a perspective view of the process cartridge 1, and FIG. 2B is a cross-sectional view of the process cartridge 1.

As illustrated in FIG. 2B, the process cartridge 1 includes a photoconductor 10 serving as a latent image bearer. Around the photoconductor 10, devices to execute image forming processes on the photoconductor 10, namely, a charging device 11, a developing device 12, a cleaning device 14, and the like are disposed. The process cartridge 1 includes a frame 10A to support the components of the process cartridge 1 as a unit. The process cartridge 1 is removably mountable in the apparatus body 100. When the photoconductor 10, the charging device 11, the developing device 12, and the cleaning device 14 are united into the process cartridge 1, replacement work and maintenance work can be easier. Additionally, in the process cartridge 1, the relative positions of the components can be kept at a higher degree of accuracy, thus enhancing the quality of images produced.

The charging device 11 (i.e., a charger) includes a charging roller 11*a* and a removing roller 11*b*. A charging bias is applied to the charging roller 11*a*, and the charging roller 11*a* gives electrical charges to the surface of the photoconductor 10 to uniformly charge the photoconductor 10. The removing roller 11*b* removes substances, such as toner, adhering to the surface of the charging roller 11*a*.

The developing device 12 includes a first developer compartment V1, in which a first conveying screw 12*b* serving as a developer conveyor is disposed. The developing device 12 further includes a second developer compartment V2 (a developer containing compartment), in which a second conveying screw 12*c* serving as another developer conveyor, a developing roller 12*a* serving as a developer bearer, and a developer doctor 12*d* serving as a developer regulator are disposed.

The first and second developer compartments V1 and V2 contain two-component developer including magnetic carrier and negatively charged toner. Being rotated by a driver, the first conveying screw 12*b* transports the developer inside the first developer compartment V1 to the front side of the paper on which FIG. 2A is drawn. At the end of the first developer compartment V1 on the front side, the developer transported by the first conveying screw 12*b* enters the second developer compartment V2.

Being rotated by the driver, the second conveying screw 12*c* inside the second developer compartment V2 transports the developer to the back side of the paper on which FIG. 2A is drawn. Above the second conveying screw 12*c* in FIG. 2B, the developing roller 12*a* (the developer bearer) is disposed in parallel to the second conveying screw 12*c*. The developing roller 12*a* includes a nonmagnetic developing sleeve 12*a*2 (illustrated in FIG. 6) that rotates and a stationary magnet roller 12*a*1 disposed inside the developing sleeve 12*a*2. The magnet roller 12*a*1 serves as a magnetic field generator.

A portion of the developer transported by the second conveying screw 12*c* is scooped onto the surface of the developing roller 12*a* due to the magnetic force exerted by the magnet roller 12*a*1. The developer doctor 12*d* is rod-shaped and disposed across a predetermined gap from the surface of the developing roller 12*a*. The developer doctor 12*d* adjusts the thickness of a layer of developer borne on the developing roller 12*a*. Subsequently, the developer is transported to the developing range opposing the photoconductor 10, and the toner in the developer adheres to an electrostatic latent image on the photoconductor 10. Thus, a toner image is formed on the photoconductor 10. After the toner therein is thus consumed, the developer is returned to the second conveying screw 12*c* as the developing roller 12*a* rotates. The developer transported to the end of the second developer compartment V2 by the second conveying screw 12*c* is returned to the first developer compartment V1. Thus, the developer is circulated inside the developing device 12.

The developing device 12 further includes a toner concentration sensor 124 (illustrated in FIG. 5) serving as a toner concentration detector to detect the content (or percentage) of toner in the developer in the first developer compartment V1. For example, the toner concentration sensor 124 measures the toner concentration based on the magnetic permeability of the developer. As the toner concentration decreases, the magnetic carrier becomes denser, and the magnetic permeability increases. When a value detected by the toner concentration sensor 124 deviates from a target value (threshold), toner is supplied from a toner bottle 20 (illustrated in FIG. 1), serving as a toner container, to the developing device 12 to keep the toner concentration constant or substantially constant. For the target value, a toner pattern is formed on the photoconductor 10, and an optical sensor detects the amount of toner adhering to the toner pattern. The target value is determined based on the detected toner adhesion amount.

Although this operation is performed to keep the density of the toner pattern (i.e., a reference pattern) on the photoconductor 10 constant, decreases in the toner concentration in the developer are inevitable when the toner bottle 20 becomes empty. In such a situation, even if the operation to supply the toner from the toner bottle 20 is executed for a certain length of time, the toner adhesion amount of the toner pattern, detected by the optical sensor, does not recover. Accordingly, in a case where the toner adhesion amount of the toner pattern, detected by the optical sensor, does not recover despite the operation to supply the toner from the toner bottle 20, a controller of the image forming apparatus 500 determines (or estimates) that there is no toner (toner end).

After the toner bottle 20 is replaced in response to the determination of "toner end", the following operation is executed to supply toner from the toner bottle 20 to the developing device 12. The developing roller 12*a* and the first and second conveying screws 12*b* and 12*c* are rotated to mix the supplied toner with the developer. At that time, to prevent uneven vibration given to the developer borne on the developing roller 12*a*, the photoconductor 10 is rotated with the potentials thereof kept to a degree not to attract the toner.

The cleaning device 14 includes a cleaning blade 14*a* that contacts or abuts against the photoconductor 10 to scrape off the toner adhering to the photoconductor 10 after a transfer process. The cleaning device 14 further includes a toner collecting coil 14*b* disposed in a collected toner compartment W to transport the toner collected by the cleaning blade 14*a*. The collected toner is further transported by a toner conveyance device to either the developing device 12 or a waste-toner bottle 41.

A transfer device 17 illustrated in FIG. 1 includes a transfer roller 16 pressed to the surface of the photoconductor 10. Disposed above the transfer device 17 is a thermal fixing device 24, which includes a heating roller 25 and a pressing roller 26. The apparatus body 100 further contains a laser writing device 21 serving as a latent image forming device. The laser writing device 21 includes a laser light source, a polygon mirror for scanning, a polygon motor, an fθ lens, and the like. The apparatus body 100 further contains sheet trays 22 stacked one on another, to store sheets S of recording media such as paper and overhead projector (OHP) transparencies.

To make copies using the image forming apparatus 500 configured as described above, when a user presses a start button, the scanner 200 reads the contents of the document set therein. Simultaneously, a photoconductor driving motor drives the photoconductor 10, and the charging device 11 including a charging roller 11*a* uniformly charges the surface of the photoconductor 10. Subsequently, the laser writing device 21 emits a laser beam according to the contents of the document scanned by the scanner 200, thus writing a latent image on the photoconductor 10. The developing device 12 develops the electrostatic latent image with the toner into a visible image.

When the user presses the start button, a pickup roller 27 sends out the sheet S from the selected sheet tray 22. One sheet S is separated from the rest by a sheet feeding roller 28 and a separation roller 29 and fed to a feeding path R1. In the feeding path R1, multiple conveyance roller pairs 30 transport the sheet S, and the sheet S is caught in a registration roller pair 23. The registration roller pair 23 forwards the sheet S to a transfer nip, where the transfer roller 16 contacts the photoconductor 10, timed to coincide with the arrival of the toner image on the photoconductor 10.

In the transfer nip, the transfer device 17 transfers the toner image onto the sheet S from the photoconductor 10. The cleaning device 14 removes the toner remaining on the photoconductor 10 after the image transfer, and a discharger removes residual potentials from the photoconductor 10. Then, the apparatus is prepared for subsequent image formation started by the charging device 11.

Meanwhile, the sheet S is guided to the fixing device 24. While passing between the heating roller 25 and the pressure roller 26, the sheet S is heated and pressed to fix the toner image on the sheet S. Subsequently, an ejection roller pair 31 discharges the sheet S to a sheet stack section 32.

Next, a configuration and operation of the developing device 12 is described in further detail below.

Figure 3:
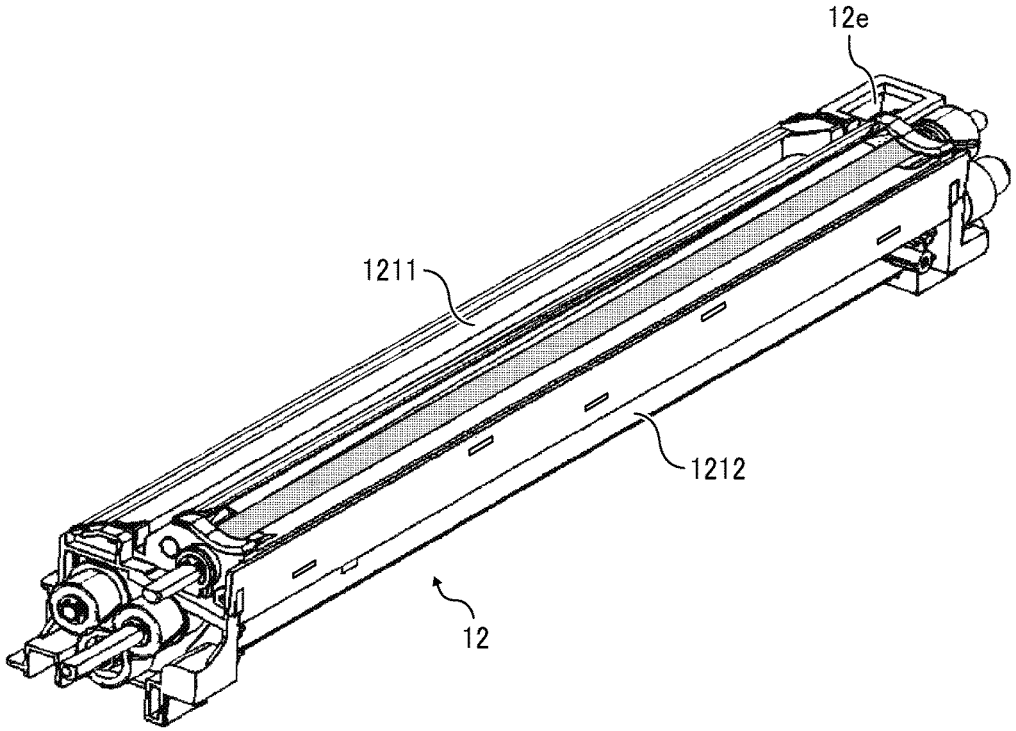
FIG. 3 is a perspective view illustrating an exterior of a developing device according to an embodiment.

FIG. 3 is a perspective view illustrating an exterior of the developing device 12.

Figure 4A:
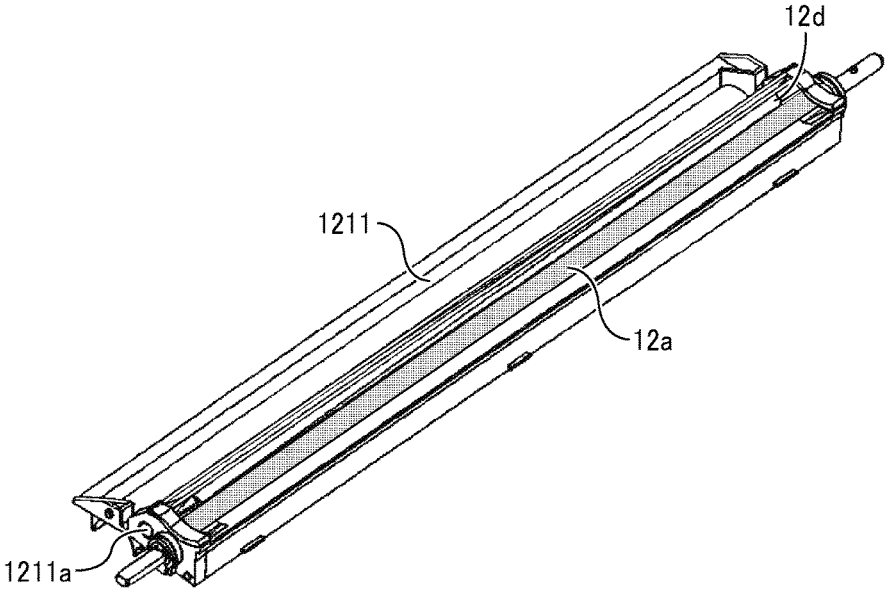
FIGS. 4A and 4B are perspective views of the developing device illustrated in FIG. 3, divided into an upper casing and a lower casing to illustrate an interior of a developer containing compartment.
Figure 4B:
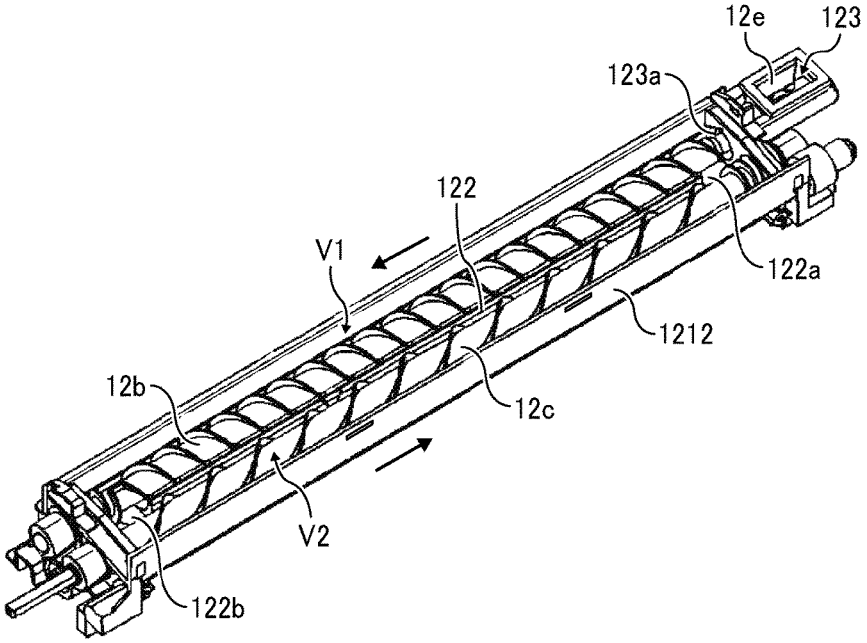

FIGS. 4A and 4B are perspective views of the developing device 12 divided into an upper casing 1211 and a lower casing 1212 to illustrate an interior of the developer containing compartment. The upper casing 1211 and the lower casing 1212 together form a developing device casing 121 (illustrated in FIG. 5).

Figure 5:
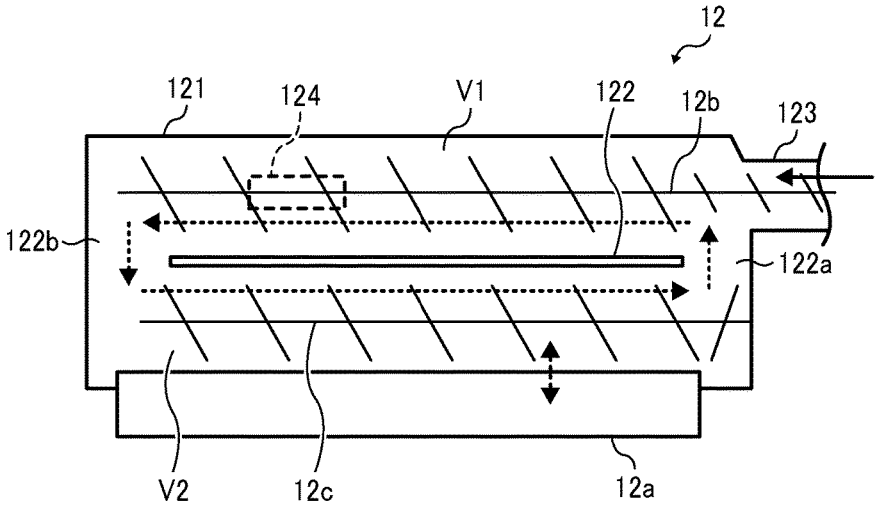
FIG. 5 is a schematic diagram illustrating a circulation passage of developer in the developing device illustrated in FIG. 3.

FIG. 5 is a schematic diagram illustrating a circulation passage of the developer in the developing device 12. In FIG. 5, broken lines represent the flow of the developer, and solid lines represent the flow of the toner supplied from a toner supply inlet 12*e*.

As illustrated in FIG. 4A, the developing roller 12*a* is rotatably supported by the upper casing 1211. The developer doctor 12*d*, which is rod-shaped, fits in holes 1211*a* in walls of the upper casing 1211 at both ends in the longitudinal direction of the developing device 12 (an axial direction of the developing roller 12*a*).

The lower casing 1212 defines the developer containing compartment inside the developing device 12. A partition 122 divides the developer containing compartment into the first developer compartment V1 and the second developer compartment V2. The first and second conveying screws 12*b* and 12*c* are disposed in the first and second developer compartments V1 and V2, respectively. The lower casing 1212 supports the first and second conveying screws 12*b* and 12*c* rotatably. The first developer compartment V1 communicates with the first developer compartment V1 through openings 122*a* and 122*b* located at ends of the partition 122.

At the downstream end of the second developer compartment V2 in the direction in which the second conveying screw 12*c* transports the developer, the developer moves to the first developer compartment V1, through the opening 122*a* at the end of the partition 122. Inside the first developer compartment V1, while stirring the developer, the first conveying screw 12*b* transports the developer in the direction opposite the direction in which the developer moves inside the second developer compartment V2. At the downstream end of the first developer compartment V1 in the direction in which the first conveying screw 12*b* transports the developer, the developer moves through the opening 122*b* to the second developer compartment V2. Thus, the first and second conveying screws 12*b* and 12*c* disposed in the first and second developer compartments V1 and V2, respectively, circulate the developer inside the developer containing compartment partitioned by the partition 122.

The upstream end of the first developer compartment V1 in the developer conveyance direction communicates with a toner supply passage 123. The toner supply inlet 12*e* is disposed in the toner supply passage 123. Through the toner supply inlet 12*e*, fresh toner and the toner collected by the cleaning device 14 are supplied. The first conveying screw 12*b* disposed in the first developer compartment V1 extends into the toner supply passage 123. The first developer compartment V1 communicate with the toner supply passage 123 through a communication opening 123*a*. The toner supplied from the toner supply inlet 12*e* is transported by the first conveying screw 12*b* inside the toner supply passage 123 and transported to the first developer compartment V1 through the communication opening 123*a*. The toner concentration sensor 124 to detect the toner concentration of the developer is disposed below the first developer compartment V1 of the lower casing 1212.

Figure 6:
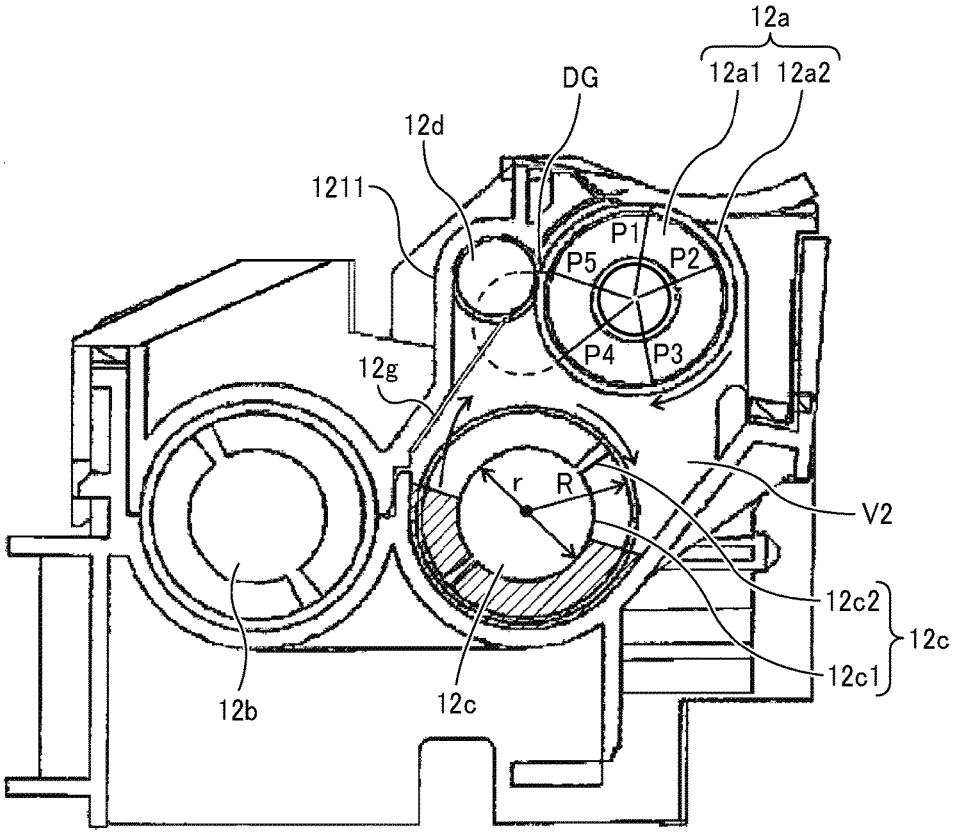
FIG. 6 is a schematic cross-sectional view of a developing device according to an embodiment.

FIG. 6 is a schematic cross-sectional view of the developing device 12 according to the present embodiment.

The developing roller 12*a* according to the present embodiment includes the developing sleeve 12*a*2 and the magnet roller 12*a*1 (i.e., the magnetic field generator) stationarily disposed inside the developing sleeve 12*a*2. The magnet roller 12*a*1 in the present embodiment is columnar and made of a mixture of resin and magnetic powder, and the surface is subjected to magnetization treatment to have five magnetic poles P1 through P5, which are peaks of magnetic-flux density in the direction normal to the surface of the developing roller 12*a* (i.e., normal magnetic-flux density). The magnetic pole P1 opposes the photoconductor 10 and hereinafter also referred to as "developing pole P1". The magnetic pole P2 exerts a magnetic force to transport the developer that has passed the developing range into the developing device casing 121 (hereinafter also "conveyance pole P2"). The magnetic pole P4 exerts a magnetic force to scoop the developer from the second developer compartment V2 (hereinafter also "developer scooping pole P4"). The magnetic pole P5 is located downstream from a doctor gap DG in the direction of rotation of the developing roller 12*a* (hereinafter also "regulation pole P5"). The magnetic pole P3 is identical in polarity to the conveyance pole P2 and exerts a magnetic force to release the developer from the developing sleeve 12*a*2 (hereinafter also "developer release pole P3").

Figure 7:
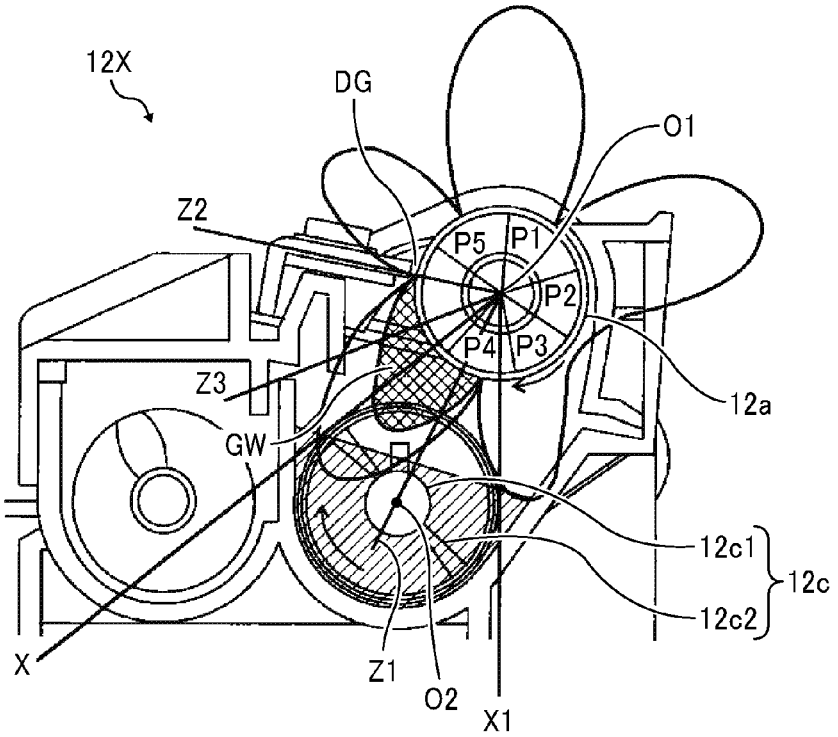
FIG. 7 is a schematic end-on axial view of a developing device according to a comparative example.

FIG. 7 is a cross-sectional view of a comparative developing device 12X.

Referring to FIG. 7, in the comparative developing device 12X, the developer containing compartment is filled with the developer to a level to hide a shaft 12*c*1 of the second conveying screw 12*c*. The carrier of the developer is not consumed but remains in the developing device. The carrier deteriorates over time while being used. Accordingly, the carrier is replaced regularly. If the developer containing compartment contains the developer to the level to hide the shaft 12*c*1 of the second conveying screw 12*c*, at replacement, a large amount of degraded carrier is discarded, which is a large environmental load. In the present embodiment, to alleviate the environmental load, the amount of the developer contained in the developer containing compartment is reduced to a half of the amount in the comparative developing device 12X. As the amount of the developer contained in the developer containing compartment decreases, the weight of the developing device 12 decreases, and the energy to transport the device is reduced. Additionally, the load of rotation of the first and second conveying screws 12*b* and 12*c* decreases, thereby reducing the energy to operate the developing device 12. Thus, the environmental load can be reduced further.

As the developer is reduced, the level of the developer in the second developer compartment V2 descends. Consequently, most of the developer is scooped only to a middle height of a left side wall of the second developer compartment V2 in the drawings, and a small amount of developer is scooped, by a spiral blade 12*c*2 of the second conveying screw 12*c*, to the range of the normal magnetic-flux density of the developer scooping pole P4, indicated by a curved line P4R in FIG. 10, of five petal-like lines representing distribution of normal magnetic-flux density. Then, the amount of developer scooped by the developer scooping pole P4 is insufficient, and the image density of developed images is lower than an intended image density.

In view of the foregoing, in the present embodiment, as illustrated in FIG. 6, a diameter r of the shaft 12*c*1 of the second conveying screw 12*c* is made greater than a radius R of the second conveying screw 12*c*. With this configuration, the shaft 12*c*1 of the second conveying screw 12*c* reduces the capacity of the second developer compartment V2, and the level of the developer in the second developer compartment V2 is raised. Accordingly, even in the configuration in which the amount of developer in the developer containing compartment is reduced by half, decreases in the level of the developer in the second developer compartment V2 are inhibited. Then, the spiral blade 12*c*2 of the second conveying screw 12*c* can bring up the developer close to the developing roller 12*a*, and the developer scooping pole P4 of the second developer compartment V2 can preferably attract the developer. Accordingly, even in the configuration in which the amount of developer in the developing device casing 121 is reduced by half, decreases in the amount of the developer scooped are inhibited, thereby suppressing decreases in the image density.

In FIG. 7, a first line Z1 connects a rotation center O1 of the developing roller 12*a* and a rotation center O2 of the second conveying screw 12*c*, and a second line Z2 connects the rotation center O2 of the developing roller 12*a* and the doctor gap DG, which is a smallest gap between the surface of the developing roller 12*a* and the developer doctor 12*d*. Further, FIG. 7 includes a bisector Z3 of an angle between the first line Z1 and the second line Z2 in the direction from the first line Z1 toward the second line Z2, of the angles formed by the first line Z1 and the second line Z2. In the comparative developing device 12X, the developer scooping pole P4 is disposed upstream in the direction of rotation of the developing roller 12*a* from the bisector Z3 of the angle extending from the first line Z1 to the second line Z2. In such a configuration, as illustrated in FIG. 7, the peak of the normal magnetic-flux density of the developer scooping pole P4 falls in a range between two lines X and X1, which are tangential to the second conveying screw 12*c* and pass the rotation center O1 of the developing roller 12*a*. As a result, a part of the second conveying screw 12*c* is positioned in the range of the normal magnetic-flux density of the developer scooping pole P4. In such a configuration, a portion of developer GW scooped by the magnetic force in the normal direction, exerted by the developer scooping pole P4, extends into the layout area of the second conveying screw 12*c*. In the layout area of the second conveying screw 12*c*, the developer GW is pressed to the surface of the developing roller 12*a* by the spiral blade 12*c*2 of the second conveying screw 12*c*. Being pressed, the developer GW in the layout area of the second conveying screw 12*c* becomes denser than other areas.

Since the second conveying screw 12*c* rotates, the position where the spiral blade 12*c*2 presses the developer GW changes in the axial direction (developer conveyance direction) of the second conveying screw 12*c* from moment to moment. Since the developing roller 12*a* rotates as well, the position to which the developer GW is pressed by the spiral blade 12*c*2 changes in the direction of rotation of the developing roller 12*a* from moment to moment. Consequently, corresponding to the pitch of the spiral blade 12*c*2, there arises a streak of denser developer that is oblique to the direction of rotation of the second conveying screw 12*c*. In the streak of denser developer, the amount of toner is greater than other areas, and the developing capability is higher. As a result, in a developed image, a portion developed with the denser developer has a higher image density. In the developed image, a streak where the image density is higher occurs obliquely corresponding to the screw-blade pitch of the second conveying screw 12*c*, thus making the image density uneven.

Figure 8:
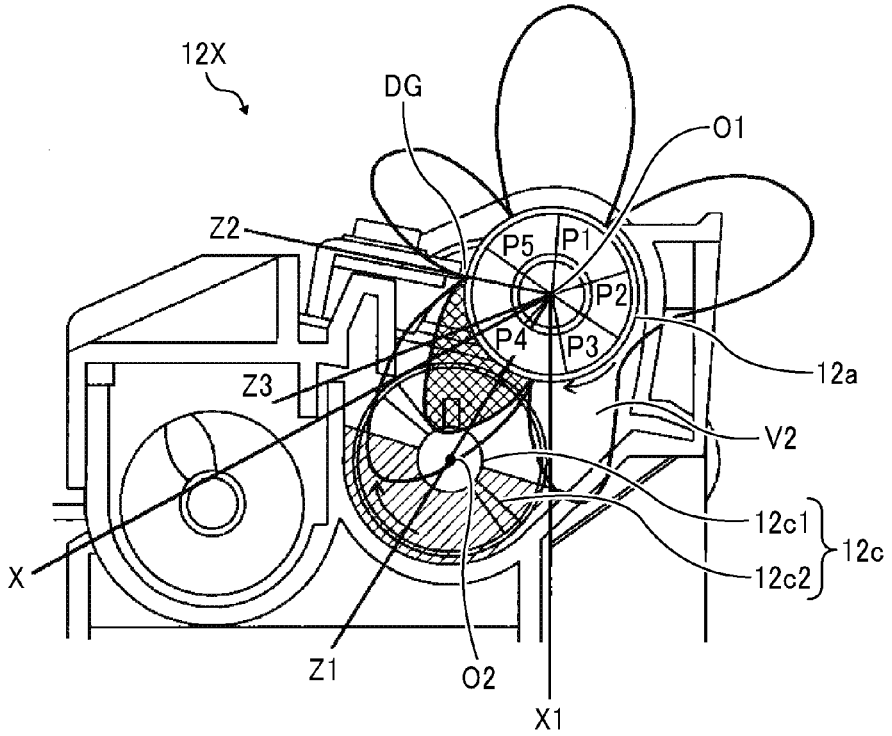
FIG. 8 is a schematic end-on axial view of a developing device according to another comparative example, in which a bottom of a developer containing compartment is raised.

In particular, as illustrated in FIG. 8, in a configuration in which the amount of developer contained in the developer containing compartment is reduced and the bottom of the second developer compartment V2 is raised to bring the developer surface close to the developing roller 12*a*, the distance between the second conveying screw 12*c* and the developing roller 12*a* is short. Consequently, the scooped developer is more strongly pressed to the surface of the developing roller 12*a*, and the developer is more likely to become dense. Then, the above-described uneven image density corresponding to the screw-blade pitch of the second conveying screw 12*c* is more likely to occur.

Figure 9A:
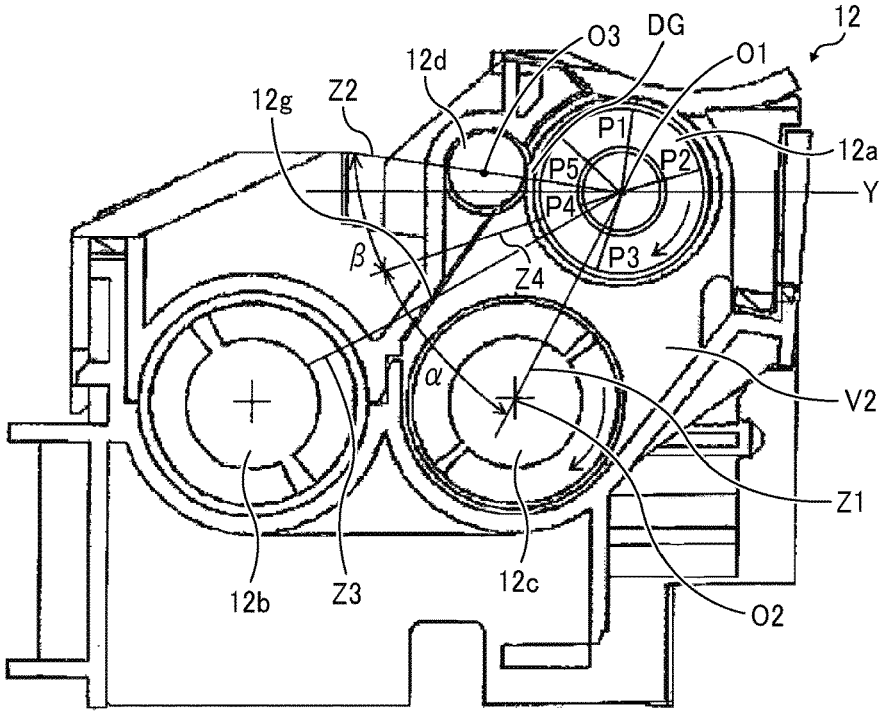
FIG. 9A is a schematic cross-sectional view illustrating location of a developer scooping pole in the developing device illustrated in FIG. 6.
Figure 9B:
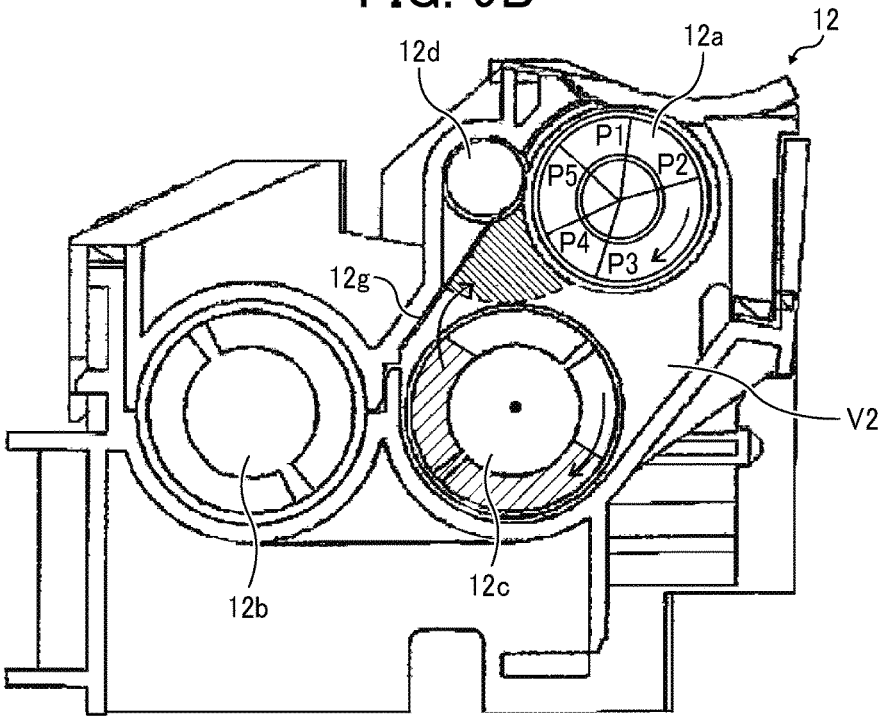
FIG. 9B is a schematic cross-sectional view illustrating the developer scooped by the developer scooping pole in the developing device illustrated in FIG. 6.
Figure 10:
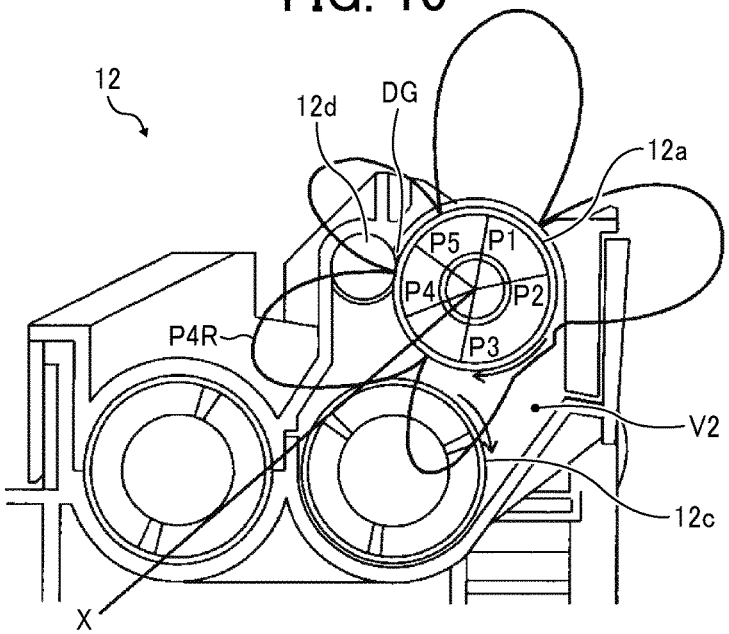
FIG. 10 illustrates distribution of magnetic-flux density in a normal direction of a developing roller, in the developing device illustrated in FIG. 6.

FIG. 9A is a schematic cross-sectional view illustrating location of the developer scooping pole P4 in the developing device 12 illustrated in FIG. 6, according to the present embodiment. FIG. 9B is a schematic cross-sectional view illustrating the developer scooped by the developer scooping pole P4 in the developing device 12 illustrated in FIG. 6. FIG. 10 illustrates the distribution of magnetic-flux density in the normal direction in the developing device 12 illustrated in FIG. 6.

As illustrated in FIG. 10, in the present embodiment, the regulation pole P5 is disposed downstream from the doctor gap DG in the direction of rotation of the developing roller 12*a*. The developer doctor 12*d* is disposed such that the doctor gap DG is positioned at a position where the normal magnetic-flux density of the regulation pole P5 and the normal magnetic-flux density of the developer scooping pole P4 are low and the magnetic forces thereof rarely act. The developer borne on the surface of the developing roller 12*a* stands on end on and forms a magnetic brush at a position where the normal magnetic-flux density reaches a peak and lies down at a position where the normal magnetic-flux density is close to zero. When the doctor gap DG is disposed at the position where the normal magnetic-flux density is close to zero, the amount of developer passing through the doctor gap DG can increase, thereby enhancing the developing capability.

Referring to FIG. 9A, the position of the developer scooping pole P4 in the present embodiment is described. The developer scooping pole P4 is disposed downstream in the direction of rotation of the developing roller 12*a* from the bisector Z3 of the angle extending from the first line Z1 to the second line Z2 in the rotation direction of the developing roller 12*a*, of the two angles formed by the first line Z1 and the second line Z2. The first line Z1 connects the rotation center O1 of the developing roller 12*a* and the rotation center O2 of the second conveying screw 12*c*, and the second line Z2 connects the rotation center O2 and a center O3 of the developer doctor 12*d* (the doctor gap DG). Specifically, in FIG. 9A, Z4 represents a peak position line connecting the developer scooping pole P4 (i.e., the peak position of the distribution of normal magnetic-flux density indicated by the curved line P4R in FIG. 10) and the rotation center O1, $\alpha$ represents an angle between the peak position line Z4 and the first line Z1, and $\beta$ represents an angle between the peak position line Z4 and the second line Z2. In the present embodiment, the developer scooping pole P4 is disposed such that the angle $\alpha$ is greater than $\beta$ ($\alpha>\beta$).

In the configuration described with reference to FIG. 9A, as illustrated in FIG. 10, the peak of the normal magnetic-flux density of the developer scooping pole P4 is closer to the developer doctor 12*d* than the tangent line X is. In other words, the developer scooping pole P4 is positioned between the developer doctor 12*d* and the tangent line X. The tangent line X is the downstream one (on the side of the developer doctor 12*d*) of the two tangent lines X and X1 (tangential to the second conveying screw 12*c* and passing the rotation center O1) in the rotation direction of the developing roller 12*a*. Compared with the comparative example illustrated in FIG. 7, this arrangement better inhibits the developer scooped onto the developing roller 12*a* from extending into the area of the second conveying screw 12*c*. In particular, in the present embodiment, as illustrated in FIG. 10, the developer scooping pole P4 is disposed such that the normal magnetic-flux of the developer scooping pole P4 rarely acts in the layout area of the second conveying screw 12*c*. Accordingly, the developer is attracted by the magnetic force of the developer scooping pole P4 in a range hatched diagonally in FIG. 9B, which does not include the layout area of the second conveying screw 12*c*. Consequently, the scooped developer is not pressed to the surface of the developing roller 12*a* by the spiral blade 12*c*2 of the second conveying screw 12*c*, thereby inhibiting creation of a dense portion in the developer borne on the developing roller 12*a*. Thus, the placement of the developer scooping pole P4 illustrated in FIGS. 9A and 10 inhibits the above-described uneven image density in the shape of oblique streaks corresponding to the screw-blade pitch of the second conveying screw 12*c*.

Additionally, in the present embodiment, as illustrated in FIG. 9A, the center O3 of the developer doctor 12*d* is above a horizontal line Y passing the rotation center O1 of the developing roller 12*a*. With this arrangement, when the developer scooping pole P4 is disposed on the side of the developer doctor 12*d*, beyond the bisector Z3, the developer scooping pole P4 is separated from the second conveying screw 12*c* positioned lower than the developing roller 12*a*. This arrangement further inhibits the normal magnetic-flux of the developer scooping pole P4 from extending into the layout area of the second conveying screw 12*c*.

Referring to FIG. 10, although the range of the normal magnetic-flux density of the developer release pole P3 extends into the layout area of the second conveying screw 12*c*, little developer is attracted by the magnetic force of the developer release pole P3 and scooped onto the surface of the developing roller 12*a*. Accordingly, almost no developer is attracted by the magnetic force of the developer release pole P3 and transported to the layout area of the second conveying screw 12*c*. That is, the developer attracted by the magnetic force of the developer release pole P3 is not pressed to the surface of the developing roller 12*a*.

In the present embodiment, as illustrated in FIG. 6, the developer doctor 12*d* is rod-shaped and circular in cross section. As the developer doctor 12*d*, a solid rod cut from a base material, subjected only to end-face treatment, can be used. Thus, the production cost can be low. Additionally, when the developer doctor 12*d* is press-fitted into the upper casing 1211, which supports the developing roller 12*a* rotatably, as illustrated in FIG. 4A, the positions of the developer doctor 12*d* and the developing roller 12*a* can be determined relative to an identical component. Accordingly, the accumulation of dimensional tolerance can be kept minimum, and the doctor gap DG, which is the smallest gap between the developing roller 12*a* and the developer doctor 12*d*, can be formed with a high degree of accuracy.

Referring to FIGS. 9A through 10, in the present embodiment, the developer scooping pole P4 is positioned on the side of the developer doctor 12*d* beyond the bisector Z3 to inhibit the normal magnetic-flux of the developer scooping pole P4 from acting in the layout area of the second conveying screw 12*c*. In this arrangement, the magnetic force of the developer scooping pole P4 rarely attracts the developer lifted by the second conveying screw 12*c* onto the developing roller 12*a*. Accordingly, in the present embodiment, of the developer flipped out from the second conveying screw 12*c* due to the movement of the second conveying screw 12*c*, the magnetic force of the developer scooping pole P4 catches the developer directed to the developing roller 12*a* and scoops the developer onto the developing roller 12*a*. Therefore, in the present embodiment, the developing device 12 further includes a guide 12*g* to guide such developer flipped from the second conveying screw 12*c* toward the range (indicated by curved line P4R in FIG. 10) of the normal magnetic-flux density of the developer scooping pole P4 to efficiently scoop the developer from the second developer compartment V2 onto the developing roller 12*a*.

The guide 12*g* is made of a resin material that is deformable elastically, such as, polyethylene terephthalate (PET) and has a thickness of about 0.2 mm. The guide 12*g* is attached to an inner face of the upper casing 1211, serving a top wall of the second developer compartment V2. A first end 12*g*E (illustrated in FIG. 13A) of the guide 12*g* extending obliquely upward from the attached portion abuts against or contacts the developer doctor 12*d*. The guide 12*g* abuts against the developer doctor 12*d* (that is, the end of the guide 12*g* contacts the developer doctor 12*d*) in a state in which the guide 12*g* is deformed such that a bent portion withdraws from the developing roller 12*a* and the first end 12*g*E of the guide 12*g* is oriented to the developing roller 12*a*. Thus, the guide 12*g* serves as an inclined face that is located above the second conveying screw 12*c* and extends obliquely toward the developing roller 12*a*.

The second conveying screw 12*c* rotates clockwise in the drawings, and the spiral blade 12*c*2 of the second conveying screw 12*c* lifts the developer in the second developer compartment V2, along the left side wall of the second developer compartment V2 (a face of the partition 122 illustrated in FIGS. 4B and 5). As the second conveying screw 12*c* rotates, a portion of the lifted developer is flipped up from the second conveying screw 12*c*. A portion of the flipped developer is directed to the surface of the developing roller 12*a*, caught by the magnetic force of the developer scooping pole P4, and borne on the developing roller 12*a*. The rest of the flipped developer contacts the guide 12*g* and is directed by the guide 12*g* to the range of the normal magnetic-flux density of the developer scooping pole P4. Then, the developer is caught by the magnetic force of the developer scooping pole P4 and borne on the developing roller 12*a*.

Thus, in the present embodiment, the guide 12*g* can guide the developer that deviates the route toward the developing roller 12*a* (for example, the developer flipped directly above the second conveying screw 12*c*) and is about to fall in the second developer compartment V2. Then, the guide 12*g* directs the developer to the range of the normal magnetic-flux density of the developer scooping pole P4 to be borne on the developing roller 12*a*. Thus, the developer in the second developer compartment V2 can be scooped onto the developing roller 12*a* efficiently. Accordingly, owing to the developer scooping pole P4 disposed closer to the developer doctor 12*d* than the bisector Z3 is, even in the configuration in which the developer scooping pole P4 is away from the developer in the second developer compartment V2, the developer can be reliably scooped onto the surface of the developing roller 12*a*. Then, the magnetic force of the developer scooping pole P4 can attracts a desirable amount of developer.

Further, the guide 12*g* extends to a position close to the doctor gap DG, and the first end 12*g*E of the guide 12*g* abuts against the developer doctor 12*d*.

Figure 11:
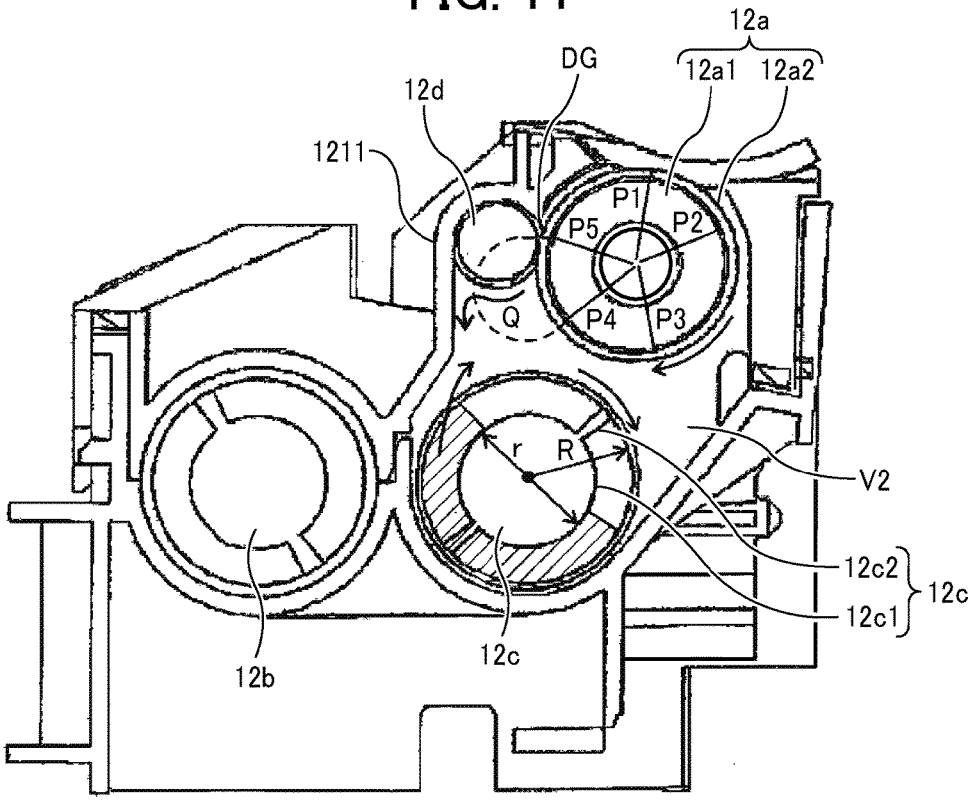
FIG. 11 illustrates movement of developer when a guide to guide developer flipped from a conveying screw is not provided in a developing device.

The developer blocked by the developer doctor 12*d* is pushed by subsequent developer. As illustrated in FIG. 11, in a configuration in which the guide 12*g* is not provided, when the developer blocked by the developer doctor 12*d* is pushed by the subsequent developer, a portion of the pushed developer leaves the developing roller 12*a* in the direction indicated by arrow Q in FIG. 11. The developer moving away from the developing roller 12*a* exits the range of the normal magnetic-flux density of the developer scooping pole P4, falls along the inner wall of the upper casing 1211 to the second developer compartment V2, and is not used in image developing.

By contrast, in the developing device 12 illustrated in FIG. 6, in which the guide 12*g* extends close to the doctor gap DG and abuts against the developer doctor 12*d*, even when the developer blocked by the developer doctor 12*d* is pushed by the subsequent developer, the guide 12*g* can inhibit the developer from moving away from the developing roller 12*a*. Then, the developer blocked by the developer doctor 12*d* can be kept in the range of the normal magnetic-flux density of the developer scooping pole P4 and inhibited from falling to the second developer compartment V2. The developer accumulates on the upstream side of the doctor gap DG in the direction of rotation of the developing roller 12*a*. Consequently, even when the developer scooped onto the developing roller 12*a* is uneven in the axial direction, the developer is leveled by the time the developer passes through the doctor gap DG. Thus, downstream from the doctor gap DG, the amount of developer can be uniform, and uneven image density of developed images can be suppressed.

The guide 12*g* can be either a rigid plate or an elastic sheet that deforms easily. When the guide 12*g* is a deformable elastic sheet, the guide 12*g* can deform to contact the developer doctor 12*d* even when the dimension of the guide 12*g* is not precise but is longer than a specified dimension to some extent. Thus, the dimensional accuracy of the guide 12*g* can be relaxed.

Figure 12A:
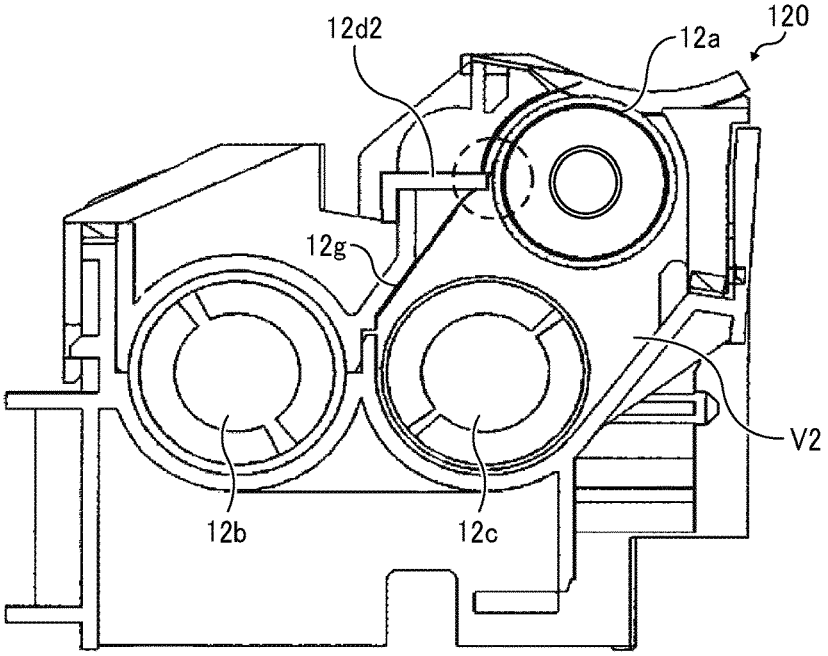
FIG. 12A is a schematic cross-sectional view of a developing device including a doctor blade as a developer regulator.
Figure 12B:
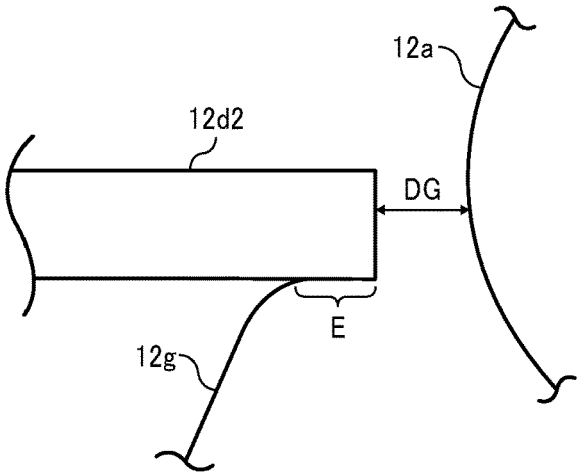
FIG. 12B is an enlarged view of an area enclosed with broken lines in FIG. 12A.

FIG. 12A is a schematic cross-sectional view of a developing device 120 that includes a doctor blade 12*d*2 as a developer regulator instead of the rod-shaped developer doctor 12*d*. FIG. 12B is an enlarged view of an area enclosed with broken lines in FIG. 12A. The developing device 120 has a structure similar to the structure of the developing device 12 illustrated in FIG. 6 except that the developer regulator is blade-shaped.

As illustrated in FIG. 12B, it is difficult to disposed the guide 12*g* in contact with (abutting against) an end of the doctor blade 12*d*2 due to variations of component. The guide 12*g* abuts against the doctor blade 12*d*2 at a position away from the end of the doctor blade 12*d*2. The clearance between the guide 12*g* and the developing roller 12*a* decreases progressively toward the doctor gap DG. However, when the position where the guide 12*g* abuts against the doctor blade 12*d*2 (i.e., an abutting position) is away from the end of the doctor blade 12*d*2, the clearance between the guide 12*g* and the developing roller 12*a* decreases sharply from the abutting position. Consequently, the developer guided by the guide 12*g* toward the doctor gap DG is dammed by an end portion E of the doctor blade 12*d*2. The dammed developer is less likely to flow to the doctor gap DG and more likely to be retained adjacent to the doctor gap DG. When the retained developer is pushed to the doctor blade 12d2 by the subsequent developer, there is a risk that the developer adheres to the end portion E.

By contrast, in the configuration illustrated in FIG. 6, in which the rod-shaped developer doctor 12d is used as the developer regulator, even when the position where the guide 12g abuts against the developer doctor 12d varies, the guide 12g and the circumference of the rod-shaped developer doctor 12d define a mildly inclined face such that the distance to the developing roller 12a decreases progressively toward the doctor gap DG. Thus, the guide 12g and the circumference of the developer doctor 12d define an inclined face that opposes the surface of the developing roller 12a and follows the flow of the developer toward the doctor gap DG. As a result, the developer pushed by the subsequent developer contacts the inclined face defined by the guide 12g and the circumference of the developer doctor 12d and moves along the inclined face to the doctor gap DG. Accordingly, the configuration illustrated in FIG. 6 inhibits the developer from being retained and guides the developer so that the developer smoothly moves toward the doctor gap DG and gradually becomes dense. Thus, the developer is inhibited from adhering to the guide 12g or the developer doctor 12d. Since the developer moves to the doctor gap DG while becoming dense, even when the developer is unevenly scooped onto the developing roller 12a, the developer can be leveled by the time the developer passes through the doctor gap DG. Thus, downstream from the doctor gap DG, the amount of developer can be uniform, and uneven image density of developed images can be suppressed.

When the guide 12g abutting against the developer doctor 12d is bent such that the first end 12gE of the guide 12g is oriented to the developing roller 12a, the following advantage is attained compared with a case where the guide 12g is bent to orient the first end 12gE thereof to the side opposite the developing roller 12a.

Figure 13A:
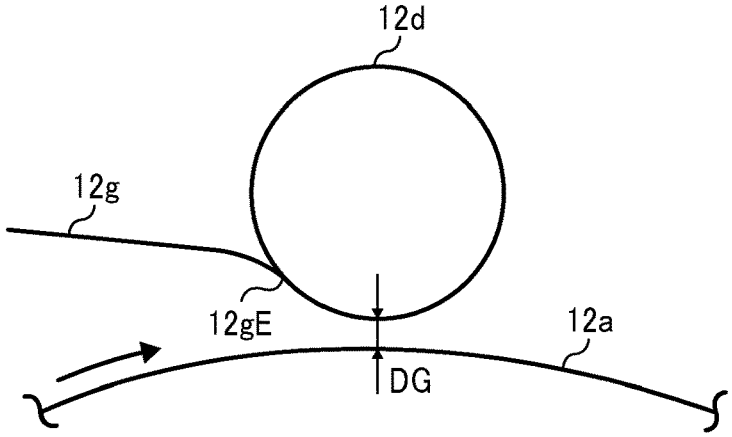
FIG. 13A is a schematic diagram in which the guide abutting against the developer doctor is bent with an end of the guide oriented to the developing roller.
Figure 13B:
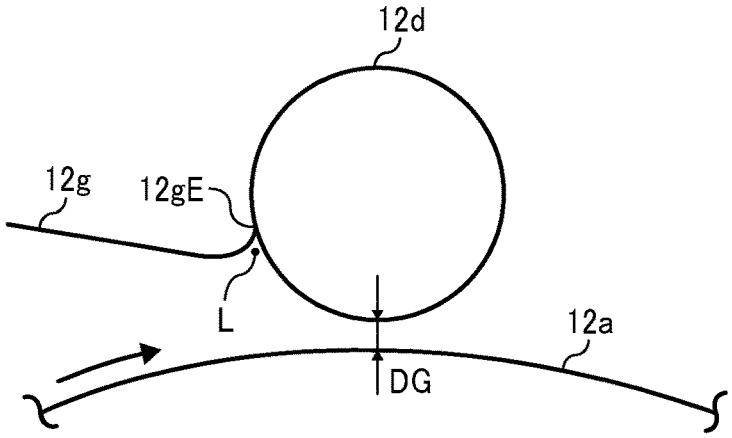
FIG. 13B is a schematic diagram in which the guide is bent with the end thereof oriented to the side opposite the developing roller.

FIG. 13A is a schematic diagram in which the guide 12g abutting against the developer doctor 12d is bent with the first end 12gE thereof oriented to the developing roller 12a. FIG. 13B is a schematic diagram in which the guide 12g is bent with the first end 12gE thereof oriented to the side opposite the developing roller 12a.

As illustrated in FIG. 13B, when the guide 12g is bent so that the first end 12gE thereof is oriented to the side opposite the developing roller 12a, the developer doctor 12d and the bent portion of the guide 12g define a wedgewise gap L. Although the clearance between the guide 12g and the developing roller 12a decreases gradually toward the doctor gap DG, the clearance abruptly increases with the bent portion of the guide 12g. The bent portion of the guide 12g may divert the direction of the developer guided by the guide 12g away from the developing roller 12a. There arises a risk that the developer enters the wedgewise gap L and accumulates.

By contrast, as illustrated in FIG. 13A, when the guide 12g is bent so that the first end 12gE thereof is oriented to the developing roller 12a, the guide 12g is coupled to the developer doctor 12d so that the clearance between the guide 12g and the developing roller 12a decreases gradually. The guide 12g is coupled to the developer doctor 12d so that the guide 12g is shaped to follow the flow of the developer to the doctor gap DG. Accordingly, the bent portion of the guide 12g does not retain the developer, and the guide 12g guides the developer smoothly to the doctor gap DG.

The various aspects of the present disclosure can attain, for example, the following effects, respectively.

Aspect 1

Aspect 1 concerns a developing device (e.g., the developing device 12) that includes a developer bearer (e.g., the developing roller 12a) that contains a magnetic field generator (e.g., the magnet roller 12a1) and is configured to bear developer and transport the developer to a developing range, a developer regulator (e.g., the developer doctor 12d) disposed opposite the developer bearer across a regulation gap (e.g., the doctor gap DG) to adjust an amount of the developer borne on a surface of the developer bearer, a developer containing compartment (e.g., the second developer compartment V2) disposed below the developer bearer, a conveying screw (e.g., the second conveying screw 12c) disposed in the developer containing compartment to transport the developer in the developer containing compartment.

Additionally, a shaft (12c1) of the conveying screw has a diameter (r) greater than a radius (R) of the conveying screw, and the magnetic field generator has a developer scooping pole (P4) to scoop the developer in the developer containing compartment onto the surface of the developer bearer. Additionally, on a cross section perpendicular to an axial direction of the conveying screw, in the rotation direction of the developer bearer, the developer scooping pole is disposed between the regulation gap and a bisector (Z3) dividing an angle extending from a first line (Z1), which connects a center (O1) of the developer bearer and a center (O2) of the conveying screw, to a second line (Z2), which connects the center (O1) of the developer bearer and the regulation gap (DG), in the rotation direction of the developer bearer.

The regulation gap is a smallest gap between the developer regulator and the surface of the developer bearer.

Being attracted by the magnetic force of the developer scooping pole to the surface of the developer bearer, the developer is borne thereon in the shape of a mountain centered on the peak of the normal magnetic-flux density of the developer scooping pole. In the comparative configuration in which the developer scooping pole (P4) is upstream from the above-mentioned bisector (Z3) in the rotation direction of the developer bearer, most of the range of the normal magnetic-flux density of the developer scooping pole P4 is located in the layout area of the conveying screw (e.g., the second conveying screw 12c). Accordingly, a portion of the mountain of developer on the surface of the developer bearer contacts the screw blade of the conveying screw. The face of the screw blade of the conveying screw is inclined relative to the axial direction and presses the developer to the surface of the developer bearer. Thus, of the developer borne on the surface of the developer, the portion of the developer that has contacted the screw blade becomes denser than the rest. The developer that has contacted the screw blade passes through the regulation gap in the dense state and reaches the developing range. In the dense portion, the amount of toner is greater than in other areas, and the developing capability is higher. In the developed image, the image density is higher in the portion corresponding to the dense portion. As a result, the image density is uneven corresponding to the screw-blade pitch of the conveying screw.

By contrast, according to Aspect 1, since the developer scooping pole (P4) is disposed downstream from the above-mentioned bisector (Z3) in the rotation direction of the developer bearer, compared with the configuration in which the developer scooping pole is upstream from the above-mentioned bisector, the developer scooping pole is further from the conveying screw. Accordingly, the developer attracted by the magnetic force of the developer scooping pole is inhibited from extending into the layout area of the conveying screw. Accordingly, the screw blade of the conveying screw is less likely to press the developer to the surface of the developer bearer, and the portion of the developer on the developer bearer corresponding to the screw-blade pitch of the conveying screw is less likely to become denser than the developer in the other areas. Accordingly, the above-described uneven image density corresponding to the screw-blade pitch of the conveying screw is inhibited.

Additionally, according to Aspect 1, the diameter (r) of the shaft of the conveying screw is greater than the radius (R) of the conveying screw.

Accordingly, compared with a case where the diameter (r) of the shaft of the conveying screw is smaller than the radius (R) of the conveying screw, the capacity of the developer containing compartment can be reduced to raise the surface level of the developer in the developer containing compartment. Accordingly, even when the amount of developer contained in the developer containing compartment is reduced from that in the comparative configuration, the developer in the developer containing compartment can be brought close to the developer scooping pole P4. Then, the developer scooping pole P4 can desirably attract the developer in the developer containing compartment, thereby suppressing the decrease in the amount of developer borne on the developer bearer such as the developing roller 12*a*. Thus, the decrease in the image density is inhibited. As the amount of the developer contained in the developer containing compartment decreases, the load given from the developing device to the environmental can decrease.

Aspect 2

In Aspect 1, the developer regulator such as the developer doctor 12*d* is rod-shaped.

As described above, a solid rod cut from a base material can be used as the rod-shaped developer regulator, subjected only to end-face treatment. Thus, the production cost of the device can be low.

Aspect 3

In Aspect 1 or 2, the developing device further includes a guide disposed above the conveying screw and extending obliquely upward toward a range of the normal magnetic-flux density of the developer scooping pole.

According to Aspect 3, as described above, when the developer scooping pole P4 is closer to the developer regulator (e.g., the developer doctor 12*d*) than the bisector (Z3), the developer scooping pole (P4) is away from the developer in the developer containing compartment (e.g., the second developer compartment V2), and the magnetic force of the normal magnetic-flux of the developer scooping pole rarely acts in the layout area of the conveying screw. The developer lifted by the screw blade of the conveying screw is not easily scooped with the magnetic force exerted by the developer scooping pole. The magnetic force of the developer scooping pole P4 mainly attracts the developer flipped toward the developer bearer, of the developer flipped out from the conveying screw by the momentum of the conveying screw, and the attracted developer is borne on the developer bearer. According to Aspect 3, the guide 12*g* can directs, to the range of the normal magnetic-flux density of the developer scooping pole, the developer flipped to the direction deviating from that range, of the developer flipped out from the conveying screw (e.g., the second conveying screw 12*c*). Then, the magnetic force of the developer scooping pole P4 can efficiently attract a desirable amount of developer from the developer containing compartment.

Aspect 4

In Aspect 3, the developer regulator such as the developer doctor 12*d* is rod-shaped, and an end of the guide 12*g* is disposed in contact with the developer regulator.

According to this aspect, as described above, the guide 12*g* and the circumference of the developer doctor 12*d* define an inclined face that opposes the surface of the developer bearer and gradually reduces the distance to the developer bearer, following the flow of the developer toward the doctor gap. Accordingly, the developer is not retained but moves smoothly toward the doctor gap.

Additionally, when the guide is disposed abutting against the developer regulator, the guide restricts the developer blocked by the developer regulator from moving away from the surface of the developer bearer. Since the developer can be kept adjacent to the developer regulator, even when the developer is unevenly scooped onto the developer bearer, the developer can be leveled by the time the developer passes through the regulation gap. Thus, downstream from the doctor gap DG, the amount of developer can be uniform, and uneven image density of developed images can be suppressed.

Additionally, when the developer regulator is rod-shaped, even when the position where the guide abuts against the developer regulator varies, the rod-shaped developer regulator provides a mildly inclined face to guide the developer toward the regulation gap. Thus, differently from the case where the developer regulator is a blade, the rod-shaped developer regulator does not dam the developer guided by the guide, and the developer can be inhibited from remaining there.

Aspect 5

In any one of Aspects 1 through 4, the developer regulator such as the developer doctor 12*d* is disposed above a horizontal line (Y) passing the center (O1) of the developer bearer such as the developing roller 12*a*.

According to this aspect, as described above, the developer scooping pole P4 can be easily disposed at a position away from the conveying screw such as the second conveying screw 12*c*, and the normal magnetic-flux of the developer scooping pole P4 is better inhibited from extending into the layout area of the conveying screw.

Aspect 6

Aspect 6 concerns a developing device (e.g., the developing device 12) that includes a developer bearer (e.g., the developing roller 12*a*) that contains a magnetic field generator (e.g., the magnet roller 12*a*1) and is configured to bear developer and transport the developer to a developing range, a developer regulator (e.g., the developer doctor 12*d*) disposed opposite the developer bearer across a regulation gap (e.g., the doctor gap DG) to adjust an amount of the developer borne on a surface of the developer bearer, a developer containing compartment (e.g., the second developer compartment V2) disposed below the developer bearer, a conveying screw (e.g., the second conveying screw 12*c*) disposed in the developer containing compartment to transport the developer in the developer containing compartment. Additionally, a shaft (12*c*1) of the conveying screw has a diameter (r) greater than a radius (R) of the conveying screw, and the magnetic field generator includes a developer scooping pole (P4) to scoop the developer in the developer containing compartment onto the surface of the developer bearer.

Additionally, on a cross section perpendicular to an axial direction of the conveying screw, the peak position of the normal magnetic-flux density of the developer scooping pole P4 is closer to the developer regulator than the tangent line X is. In other words, the peak position of the normal magnetic-flux density of the developer scooping pole P4 is disposed between the developer regulator and the tangent line (X) in the rotation direction of the developer bearer. The tangent line (X) is the downstream one (on the side of the developer doctor) of the two lines (X and X1) tangential to the conveying screw and passing the center (O1) of the developer bearer.

According to this aspect, as described above, compared with a configuration in which the peak position of the normal magnetic-flux density of the developer scooping pole is positioned upstream from the tangent line on the side of the developer regulator in the rotation direction of the developer bearer, the developer attracted by the magnetic force of the developer scooping pole is inhibited from extending into the layout area of the conveying screw. Accordingly, the screw blade of the conveying screw is less likely to press the developer to the surface of the developer bearer, and the portion of the developer on the developer bearer corresponding to the screw-blade pitch of the conveying screw is less likely to become denser than the developer in other areas. Accordingly, the above-described uneven image density corresponding to the screw-blade pitch of the conveying screw is inhibited.

Additionally, the diameter (r) of the shaft of the conveying screw is greater than the radius (R) of the conveying screw. Accordingly, compared with a case where the diameter (r) of the shaft of the conveying screw is smaller than the radius (R) of the conveying screw, the capacity of the developer containing compartment can be reduced to raise the surface level of the developer in the developer containing compartment. Accordingly, even when the amount of developer contained in the developer containing compartment is reduced from that in the comparative configuration, the developer in the developer containing compartment can be brought close to the developer scooping pole P4. Then, the developer scooping pole P4 can preferably attract the developer in the developer containing compartment, thereby suppressing the decrease in the amount of developer borne on the developer bearer such as the developing roller 12*a*. Thus, the decrease in the image density is inhibited. As the amount of the developer contained in the developer containing compartment decreases, the load given from the developing device to the environmental can decrease.

Aspect 7

In an image forming apparatus, such as the image forming apparatus 500, that includes a latent image bearer (e.g., the photoconductor 10) and a developing device to develop the latent image on the latent image bearer, the developing device according to any one of aspects 1 through 6 is used.

Accordingly, the above-described uneven image density corresponding to the screw-blade pitch of the conveying screw (e.g., the second conveying screw 12*c*) is inhibited, and desirable images can be produced.

Aspect 8

In a process cartridge that is configured to be removably mounted in an image forming apparatus and includes, at least, the latent image bearer (e.g., the photoconductor 10) and the developing device, the developing device according to any one of Aspects 1 through 6 is used.

Accordingly, with the process cartridge, the above-described uneven image density corresponding to the screw-blade pitch of the conveying screw (e.g., the second conveying screw 12*c*) is inhibited, and desirable images can be produced.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a developer bearer including a magnetic field generator, the developer bearer to bear developer and transport the developer to a developing range;

a developer regulator disposed opposite the developer bearer across a regulation gap to adjust an amount of the developer borne on a surface of the developer bearer;

a developer containing compartment disposed below the developer bearer; and a conveying screw disposed in the developer containing compartment and including a shaft having a diameter greater than a radius of the conveying screw, the conveying screw to transport the developer in the developer containing compartment, wherein the magnetic field generator has a developer scooping pole (P4) to scoop the developer in the developer containing compartment onto the surface of the developer bearer, and wherein the developer scooping pole (P4) is disposed upstream of the developer regulator in a direction of rotation of the developer bearer;

wherein, on a cross section perpendicular to an axial direction of the conveying screw, a peak position of a magnetic-flux density of the developer scooping pole (P4) in a direction normal to the surface of the developer bearer is between the regulation gap and a bisector (Z3) dividing an angle extending from a first line (Z1), which connects a center (O1) of the developer bearer and a center (O2) of the conveying screw, to a second line (Z2), which connects the center (O1) of the developer bearer and the regulation gap, in a rotation direction of the developer bearer;

wherein the developer regulator is further disposed opposite an upward moving side of a surface of the developer bearer, wherein the developer bearer disposed opposite the developer regulator is configured to rotate upward at the developer regulator; and wherein a peak of the scooping pole (P4) is closer to the developer regulator than a tangent line (X) extending from the center of the developer bearer to a tangential surface of the conveying screw.

2. The developing device according to claim 1, wherein the developer regulator is rod-shaped.

3. The developing device according to claim 2, wherein the developer regulator is cylindrical.

4. The developing device according to claim 1, further comprising a guide disposed above the conveying screw, the guide extending obliquely upward toward a range of magnetic-flux density of the developer scooping pole (P4) in a direction normal to the surface of the developer bearer.

5. The developing device according to claim 4, wherein the developer regulator is rod-shaped, and wherein an end of the guide is disposed in contact with the developer regulator.

6. The developing device according to claim 5, wherein the developer regulator is cylindrical.

7. The developing device according to claim 1, wherein the developer regulator is disposed above a horizontal line passing the center (O1) of the developer bearer.

8. An image forming apparatus comprising:

a latent image bearer to bear a latent image; and the developing device according to claim 1 to develop the latent image.

9. A process cartridge to be removably mounted in an image forming apparatus, the process cartridge comprising:

a latent image bearer to bear a latent image;

the developing device according to claim 1 to develop the latent image; and a frame to support the latent image bearer and the developing device as a unit.

10. The developing device as recited in claim 1, wherein the developer scooping pole (P4) is positioned between the developer regulator and the tangent line (X).

11. The developing device as recited in claim 1, wherein the developer scooping pole is separated from a second conveying screw.

12. The developing device according to claim 1, wherein the developer regulator is cylindrical.

13. A developing device comprising:

a developer bearer including a magnetic field generator, the developer bearer to bear developer and transport the developer to a developing range;

a developer regulator disposed opposite the developer bearer across a regulation gap to adjust an amount of the developer borne on a surface of the developer bearer;

a developer containing compartment disposed below the developer bearer; and a conveying screw disposed in the developer containing compartment and including a shaft having a diameter greater than a radius of the conveying screw, the conveying screw to transport the developer in the developer containing compartment, wherein the magnetic field generator has a developer scooping pole (P4) to scoop the developer in the developer containing compartment onto the surface of the developer bearer, wherein the developer scooping pole (P4) is disposed upstream of the developer regulator in a direction of rotation of the developer bearer, wherein, on a cross section perpendicular to an axial direction of the conveying screw, a peak position of magnetic-flux density of the developer scooping pole (P4) in a direction normal to the surface of the developer bearer is disposed between the developer regulator and a tangent line (X) in a rotation direction of the developer bearer, the tangent line (X) being a downstream one, in the rotation direction of the developer bearer, of two lines that are tangential to the conveying screw and pass a center (O1) of the developer bearer, wherein the developer regulator is further disposed opposite an upward moving side of a surface of the developer bearer, and wherein the developer bearer disposed opposite the developer regulator is configured to rotate upward at the developer regulator.

14. An image forming apparatus comprising:

a latent image bearer to bear a latent image; and the developing device according to claim 13 to develop the latent image.

15. A process cartridge to be removably mounted in an image forming apparatus, the process cartridge comprising:

a latent image bearer to bear a latent image;

the developing device according to claim 13 to develop the latent image; and a frame to support the latent image bearer and the developing device as a unit.

16. The developing device as recited in claim 13, wherein the developer scooping pole is positioned between the developer regulator and the tangent line (X).

17. The developing device as recited in claim 13, wherein the developer scooping pole is separated from a second conveying screw.

18. The developing device according to claim 13, wherein the developer regulator is cylindrical.

* * * * *